US008446241B2

(12) United States Patent
Filiputti et al.

(10) Patent No.: US 8,446,241 B2
(45) Date of Patent: May 21, 2013

(54) DEVICE FOR BREAKING/MAKING AN ELECTRIC CIRCUIT

(75) Inventors: Hugues Filiputti, Monestier de Clermont (FR); Mathias Lamien, Colombe (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 860 days.

(21) Appl. No.: 12/523,668

(22) PCT Filed: Jan. 16, 2008

(86) PCT No.: PCT/EP2008/050434

§ 371 (c)(1),
(2), (4) Date: Nov. 12, 2009

(87) PCT Pub. No.: WO2008/090065

PCT Pub. Date: Jul. 31, 2008

(65) Prior Publication Data

US 2010/0089739 A1 Apr. 15, 2010

(30) Foreign Application Priority Data

Jan. 19, 2007 (FR) ..... 07 52763

(51) Int. Cl.
*H01H 3/00* (2006.01)

(52) U.S. Cl.
USPC ..... 335/185

(58) Field of Classification Search
USPC ..... 335/185
See application file for complete search history.

(56) References Cited

U.S. PATENT DOCUMENTS

| | | | | |
|---|---|---|---|---|
| 4,342,978 | A * | 8/1982 | Meister | 337/6 |
| 4,479,105 | A * | 10/1984 | Banes | 337/4 |
| 5,732,634 | A * | 3/1998 | Flickinger et al. | 102/202.5 |
| 6,448,884 | B1 * | 9/2002 | Yamaguchi et al. | 337/401 |
| 7,059,339 | B2 * | 6/2006 | Delapierre | 137/68.13 |
| 7,812,696 | B2 * | 10/2010 | Hartinger et al. | 335/132 |
| 2006/0185728 | A1 * | 8/2006 | Delapierre | 137/68.13 |
| 2008/0094156 | A1 * | 4/2008 | Hartinger et al. | 335/185 |
| 2008/0143462 | A1 * | 6/2008 | Belisle et al. | 335/201 |

FOREIGN PATENT DOCUMENTS

| | | |
|---|---|---|
| DE | 44 06 730 | 9/1995 |
| DE | 100 54 153 | 7/2001 |

* cited by examiner

*Primary Examiner* — Alexander Talpalatski
(74) *Attorney, Agent, or Firm* — Oblon, Spivak, McClelland, Maier & Neustadt, L.L.P.

(57) ABSTRACT

The invention relates to a device for switching on and off an electric circuit comprising: a charge (5) which can be ignited, the combustion of which brings about the switching on or off of the electric circuit, ignition means for the pyrotechnic charge (5), characterized in that: the ignition means are connected to the electric circuit and the ignition means comprise a microswitch (M, M') with magnetic action for controlling the ignition of the pyrotechnic charge (5).

10 Claims, 4 Drawing Sheets

DEVICE FOR BREAKING/MAKING AN ELECTRIC CIRCUIT

Figure 1:
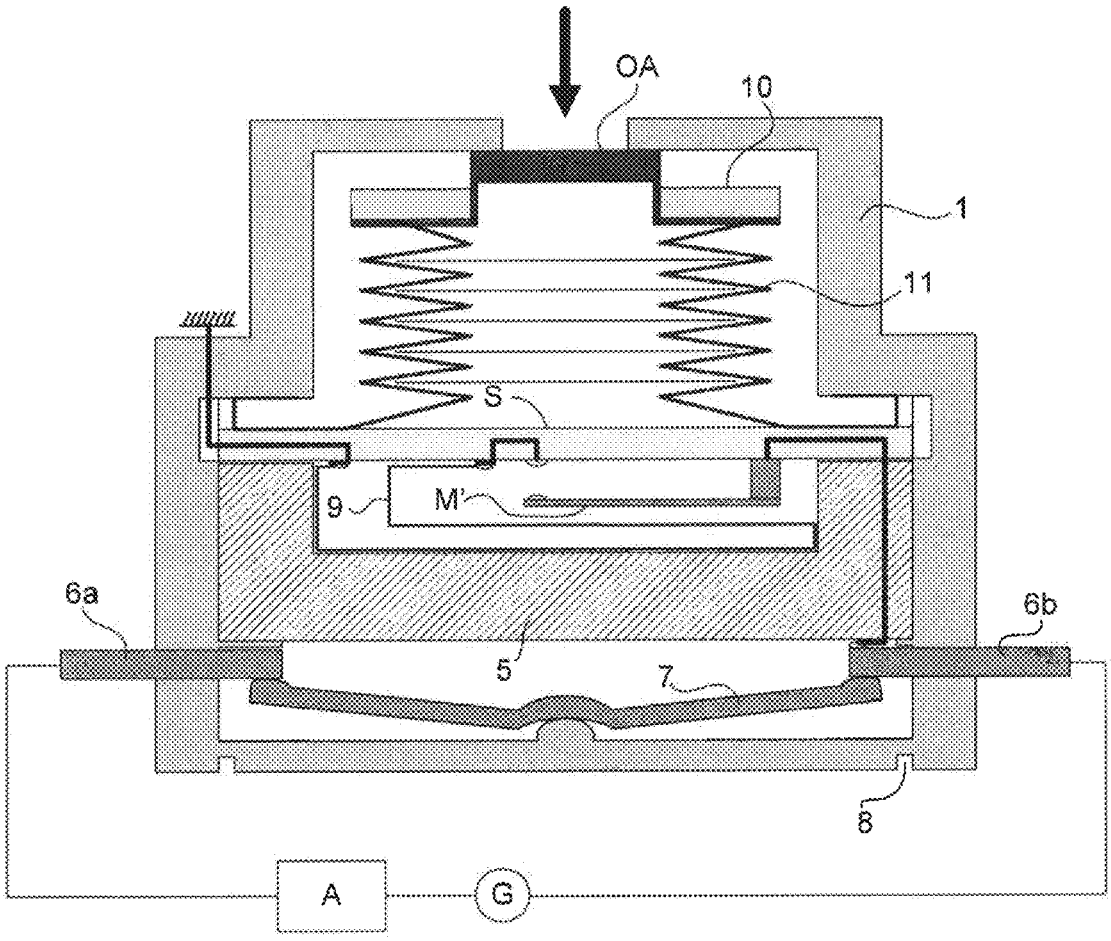

The present invention relates to a device for breaking/making an electric circuit. This device operates on the basis of a pyrotechnic charge.

Known notably from the document DE 44 06 730 is a device for breaking an electric circuit. This device notably comprises a pyrotechnic actuator comprising a pyrotechnic charge and a piston controlled in translation under the effect of the gases generated by the combustion of the pyrotechnic charge. The piston has a finger that can bear on a connecting bridge initially providing the electrical link between two conductors. This bridge is mounted on a spring. In operation, the gases generated by the combustion of the pyrotechnic charge bring about the movement of the piston which pushes on the bridge to disconnect the two conductors and thus break the electric circuit.

To control the initiation of the pyrotechnic charge, this device of the prior art requires the use of an external detection member. Furthermore, it mainly uses mechanical means that are likely to be worn over time, possibly leading to malfunctions.

The aim of the invention is to propose a device for breaking/making an electric circuit that is not sensitive to wear over time and that operates using a pyrotechnic charge, the ignition of which is directly controlled in the device.

This aim is achieved by a device for breaking/making an electric circuit, comprising:

- a pyrotechnic charge which can be ignited, the combustion of which brings about the breaking, respectively the making, of the electric circuit,
- means of igniting the pyrotechnic charge, characterized in that:

- the ignition means are connected to the electric circuit,
- the ignition means comprise a microswitch with magnetic action capable of controlling the ignition of the pyrotechnic charge.

According to a particular feature, the microswitch is placed on a circuit branch linked on the one hand to the electric circuit and on the other hand to the earth.

According to another particular feature, the ignition means comprise a heating resistive element mounted in series with the microswitch and capable of igniting the pyrotechnic charge.

According to a first variant embodiment, the microswitch is controlled by a moving permanent magnet, which can be actuated in translation for example.

According to a second variant embodiment, the microswitch is controlled by an excitation coil.

In a first configuration, the excitation coil is mounted in parallel relative to the electric circuit. The inventive device is then a device for breaking the electric circuit in which the electric circuit comprises two conductors and a connecting piece that can be displaced under the effect of the gases generated by the combustion of the pyrotechnic charge, the connecting piece initially linking the two conductors.

In a second configuration, the excitation coil is mounted in parallel relative to the microswitch. In this case, it is controlled by a sensor. The inventive device is then a switching-on device in which the electric circuit comprises two conductors and a connecting piece that can be displaced under the effect of the gases generated by the combustion of the pyrotechnic charge. In this switching-on device, the connecting piece is initially disconnected from the two conductors and it is, for example, joined to a piston separating a first chamber comprising the pyrotechnic charge from a second chamber that is passed through by the two conductors.

According to the invention, the microswitch employed comprises, for example, a membrane made of ferromagnetic material capable of being driven between two positions by being aligned on the field lines of a magnetic field.

Figure 2:
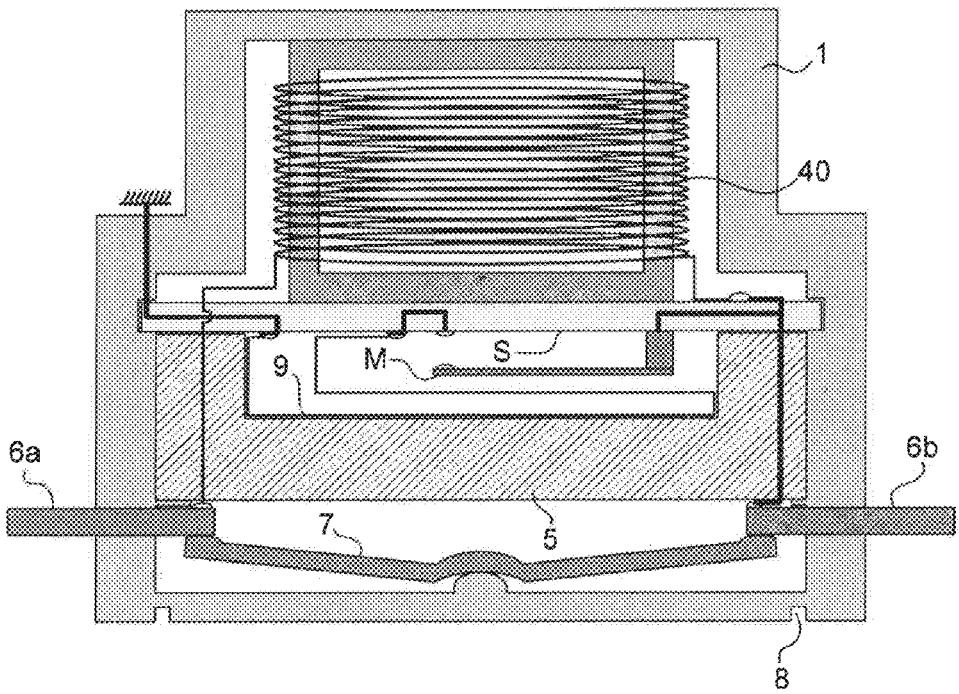
Figure 3:
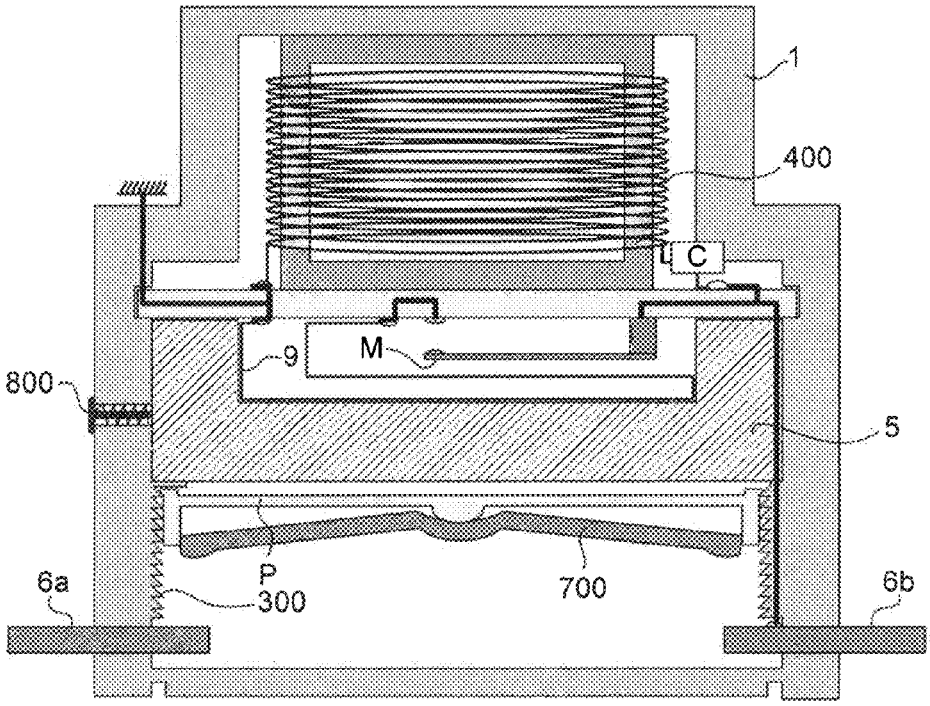
Figure 7:
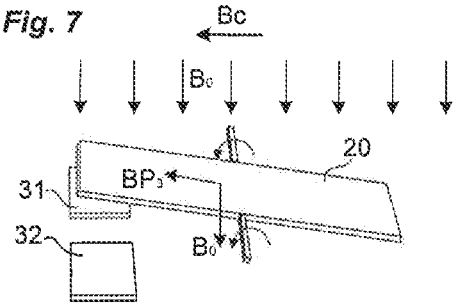
Figure 8:
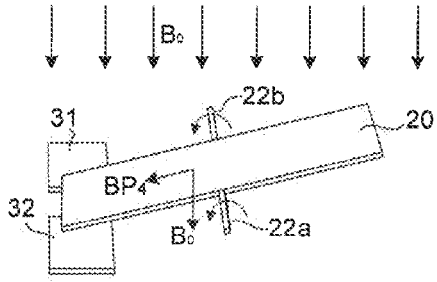
Figure 9:
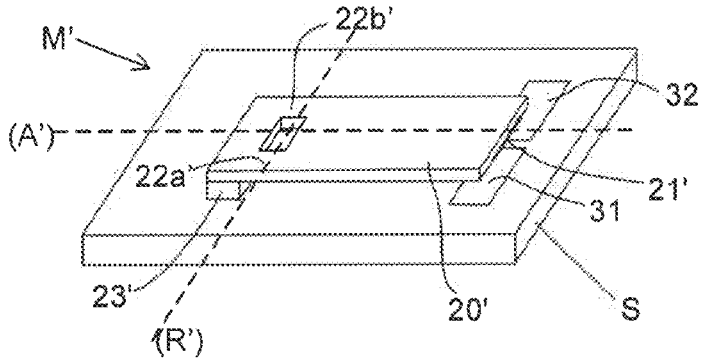
Figure 10:
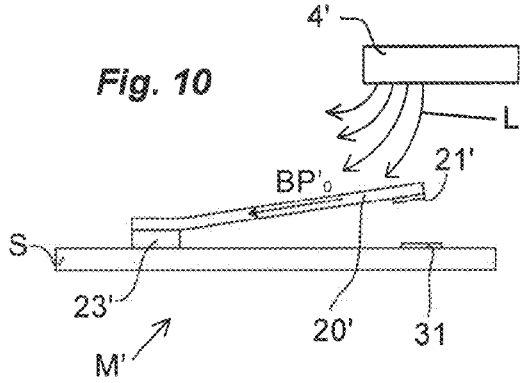
Figure 11:
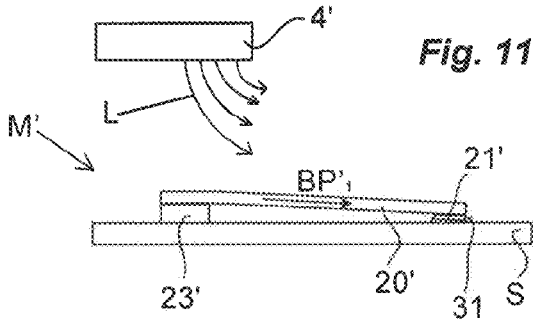

Other features and benefits will emerge from the detailed description that follows by referring to an embodiment given by way of example and represented by the appended drawings in which:

FIG. 1 diagrammatically represents a device for breaking an electric circuit according to the invention, responding to an external mechanical action, FIG. 2 diagrammatically represents a device for breaking an electric circuit according to the invention, responding to an overcurrent in the electric circuit, FIG. 3 diagrammatically represents a device for making an electric circuit according to the invention, FIGS. 4 to 8 show a first variant of a microswitch used in the invention, FIGS. 9 to 11 show a second variant of a microswitch employed in the invention.

The invention relates to a device for breaking or making a main electric circuit. This main electric circuit can, for example, be reserved for powering a battery, transformers, lift brakes or any types of circuit that need to be broken or made rapidly and reliably.

The switching-off devices represented in FIGS. 1 and 2 and the switching-on device represented in FIG. 3 each comprise a body 1 that is passed through by two electrical conductors 6*a*, 6*b* that are spaced apart and connected to a main electrical power supply circuit (FIG. 1), for example of an appliance A powered by a generator G. In a switching-off device, these two conductors 6*a*, 6*b* are initially joined by a connecting piece 7 that can be displaced initially making the electrical connection whereas in the switching-on device, these two conductors 6*a*, 6*b* are initially spaced apart and are designed to be connected by a connecting piece 700 that can be displaced. The body 1 of these devices is hermetically sealed and comprises a bottom wall on which is formed a fracture initiation score 8.

In the breaking devices, the connecting piece 7 is, for example, wedged between the two conductors 6*a*, 6*b* and the bottom wall of the body.

A pyrotechnic charge 5, for example of composite type, is placed inside the body 1. The ignition of this charge 5 generates gases inside the body 1 and provokes the breaking of the main electric circuit or the making of the main electric circuit by displacement of the connecting piece 7, 700. The gases are released by the bursting of the body 1 along the fracture initiation score 8.

According to the invention, the breaking/making devices also comprise a microswitch M, M' with magnetic action as described hereinbelow. This type of microswitch is particularly advantageous because it is housed in a perfectly hermetic casing and because it is insensitive to the problems of static electricity that can bring about the untimely combustion of the pyrotechnic charge. It could notably be manufactured by an MEMS (micro-electro-mechanical system) type technology.

Figure 4:
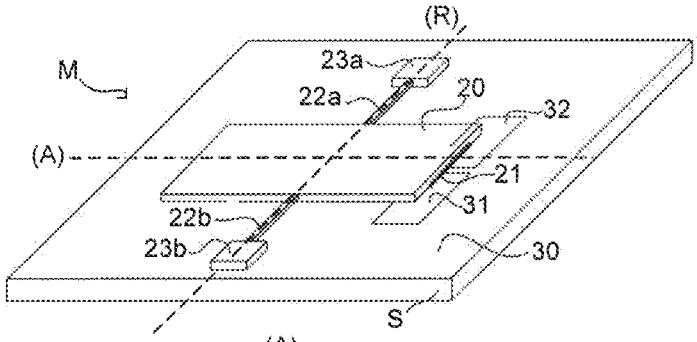

Two variants of this type of microswitch M, M' are represented in FIGS. 4 and 9. Other types of microswitches that are perfectly suited to the requirements of the invention could be envisaged, notably "reed" type microswitches.

In the two variant embodiments represented in FIGS. 4 and 9, the microswitch M, M' comprises a moving element mounted on a substrate S manufactured from materials such as silicon, glass, ceramics or in the form of printed circuits. The substrate S bears for example on its surface 30 at least two flat conductive contacts or tracks 31, 32 that are identical and spaced apart, intended to be electrically linked by a moving electrical contact 21, 21' in order to obtain the closure of an electric circuit. The moving element consists of a deformable membrane 20, 20' having at least one layer of ferromagnetic material. The ferromagnetic material is, for example, of the soft magnetic type and can be, for example, an alloy of iron and nickel ("permalloy" $Ni_{80}Fe_{20}$). Depending on the orientation of a magnetic component created in the membrane, the membrane 20, 20' can assume a bottom "closure" position, in which its moving contact 21, 21' electrically links the two fixed conductive tracks 31, 32 so as to close the electric circuit or a raised top "opening" position, in which its moving contact 21, 21' is separated from the two conductive tracks so as to open the electric circuit. In the opening position, the free space must be sufficient to comply with the "nonfire" standard in the event of a spurious current.

In the first variant represented in FIG. 4, the membrane 20 of the microswitch M has a longitudinal axis (A) and is joined to the substrate S via two link arms 22*a*, 22*b* linking said membrane 20 to two anchoring contact studs 23*a*, 23*b* arranged symmetrically on either side of its longitudinal axis (A) and extending perpendicularly relative to this axis (A). By twisting the two link arms 22*a*, 22*b*, the membrane 20 can pivot between its opening position and its closure position about a rotation axis (R) parallel to the axis described by the points of contact of the membrane 20 with the electric tracks 31, 32 and perpendicular to its longitudinal axis (A). Its moving electrical contact 21 is arranged under the membrane 20, at one end of the latter.

In this first variant, the magnetic actuation of the microswitch M consists in subjecting the membrane 20 to a permanent magnetic field $B_0$, preferably uniform and, for example, in a direction perpendicular to the surface 30 of the substrate S to keep the membrane 20 in each of its positions, and in applying a temporary controlling magnetic field Bc to drive the transition of the membrane 20 from one position to the other, by reversal of the magnetic torque being exerted on the membrane 20. Forcing the membrane 20 to open by employing a temporary magnetic field $B_0$ may prove necessary to withstand the electrostatic discharges and to give the microswitch M a strong galvanic isolation. However, it is possible to do away with the application of the permanent magnetic field $B_0$ if the membrane at rest guarantees a sufficient space on opening. To guarantee this sufficient space on opening, the membrane 20 can be mechanically prestressed, for example by adding to it a layer made from a prestressed material.

Figure 5:
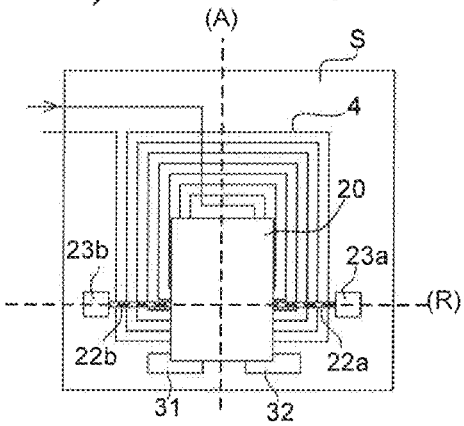

To generate the permanent magnetic field $B_0$, a permanent magnet (not represented) is used, for example fixed under the substrate S. The temporary magnetic field Bc is, for example, generated using an excitation coil 4 associated with the microswitch M. This excitation coil can be planar (FIG. 5), integrated in the substrate, or external, for example of solenoid type. The passage of a current through the excitation coil 4 generates a temporary magnetic field in a direction parallel to the substrate S and parallel to the longitudinal axis (A) of the membrane 20 to control, depending on the direction of the current in the coil, the switching over of the membrane 20 from one of its positions to the other of its positions. The operation of such a microswitch M is detailed hereinbelow in conjunction with FIGS. 6 to 8. In FIGS. 2 and 3, the coil 40, 400 is represented in the form of a winding, but it should be understood that it can take any other form, notably a planar form integrated in the substrate of the microswitch M (FIG. 5).

Figure 6:
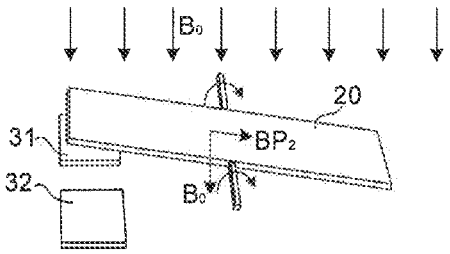

The substrate S supporting the membrane 20 is placed under the effect of the permanent magnetic field $B_0$ already defined hereinabove. As represented in FIG. 6, the first magnetic field $B_0$ initially generates a magnetic component $BP_2$ in the membrane 20 along its longitudinal axis (A). The magnetic torque resulting from the first magnetic field $B_0$ and from the component $BP_2$ generated in the membrane 20 keeps the membrane 20 in one of its positions, for example the opening position in FIG. 6.

Referring to FIG. 7, the passage of a control current in a defined direction through the excitation coil 4 generates the controlling temporary magnetic field Bc, the direction of which is parallel to the substrate S, its direction depending on the direction of the current delivered into the coil 4. The temporary magnetic field Bc generates the magnetic component $BP_3$ in the magnetic layer of the membrane 20. If the control current is delivered in an appropriate direction, this new magnetic component $BP_3$ opposes the component $BP_2$ generated in the magnetic layer of the membrane 20 by the first magnetic field $B_0$. If the intensity of the component $BP_3$ is greater than that generated by the first magnetic field $B_0$, the magnetic torque resulting from the first magnetic field $B_0$ and from this component $BP_3$ is reversed and causes the membrane 20 to switchover from its opening position to its closure position (FIG. 7).

Once the membrane 20 has been switched over, the current supplied to the coil 4 is no longer needed. According to the invention, the magnetic field Bc is generated only transitionally to cause the membrane 20 to switchover from one position to the other. As represented in FIG. 8, the membrane 20 is then held in its closure position under the effect of just the first magnetic field $B_0$ creating a new magnetic component $BP_4$ in the membrane 20 and therefore a new magnetic torque forcing the membrane 20 to be kept in its closure position (FIG. 8).

In the second variant represented in FIG. 9, the membrane 20' of the microswitch M' has a longitudinal axis (A') and is linked, at one of its ends, via link arms 22*a*', 22*b*', to one or more anchoring contact posts 23' joined to the substrate S. The membrane 20' is capable of pivoting relative to the substrate about a rotation axis (R') perpendicular to its longitudinal axis (A'). The link arms 22*a*', 22*b*' form an elastic link between the membrane 20' and the anchoring contact post 23' and are stressed to flex when the membrane 20' pivots.

In this second variant embodiment, the magnetic actuation of the microswitch M' is illustrated in FIGS. 10 and 11. It consists in applying a magnetic field created by a permanent magnet 4'. According to this actuation mode, the ferromagnetic membrane 20' is displaced between its two states by being aligned on the field lines L of the magnetic field generated by the permanent magnet 4'. The magnetic field created by the permanent magnet 4' in effect has field lines L whose orientation generates a magnetic component ($BP'_0$, $BP'_1$) in a ferromagnetic layer of the membrane 20' along its longitudinal axis (A'). This magnetic component ($BP'_0$, $BP'_1$) generated in the membrane 20' generates a magnetic torque forcing the membrane 20' to assume one of its opening (FIG. 10) or closure (FIG. 11) positions. By displacing the permanent magnet 4', it is then possible to subject the membrane 20' to two different orientations of the field lines L of the magnetic field of the permanent magnet 4' and cause the membrane 20' to switchover between its two positions. To cause the membrane 20' to switchover, the displacement of the permanent magnet 4' can be done in a direction parallel to the surface 30 of the substrate S, or perpendicular to that surface 30.

The body of the devices thus also encloses means of igniting the pyrotechnic charge 5 consisting notably of a microswitch M, M', as described hereinabove, and a heating resistive element, such as, for example, a resistive wire 9, the heating of which intended to ignite the pyrotechnic charge 5 is controlled by the microswitch M, M'. The microswitch M, M' is placed in series relative to the resistive wire 9, which is in turn linked on the one hand to the earth and on the other hand to the main electric circuit when the microswitch M, M' is closed. The resistive wire 9 is situated close to the pyrotechnic charge 5, preferably in contact with the latter or coated by the latter (variant not represented). As a variant, the igniting of the pyrotechnic charge 5 can be done directly by the microswitch by doing away with the use of the resistive wire 9. In effect, from a certain current, the microswitch can be designed to be evaporated by producing the energy needed to fire the pyrotechnic charge 5. For this, the microswitch for example comprises a fusible membrane 20 capable of being evaporated when the controlled current is too strong.

A first configuration of a breaking device is represented in FIG. 1. This breaking device is designed to react to an external mechanical action. This external mechanical action can be produced by different means, such as, for example, an increase in the pressure of a fluid (air, water or oil) or the action of an external mechanical piece set in motion following a temperature variation or in response to an impact. Any other type of sensor could be considered, notably a "multiphysical" sensor producing a mechanical response according to the variation of different physical parameters such as pressure, temperature, speed, etc.

In this first configuration, the device comprises a moving permanent magnet 10, for example in disk or toroid form, mounted on a moving actuation member OA on which the external mechanical action is exerted, coaxially relative to the axis (X) of the device. This actuation member OA is capable of being displaced in translation upon the application of a calibrated minimum external mechanical action, for example using a bellows mechanism 11, an abrupt fracture elastic membrane (not represented) or using a fixed magnet in disk or toroid form (not represented) arranged concentrically relative to the moving permanent magnet 10. When driven by the actuation member OA, the moving permanent magnet 10 can therefore be translated along the axis (X) of the device between a rest position and a working position.

In this first configuration, the microswitch M' employed is of the type of the second variant described hereinbelow. This microswitch M' is offset relative to the axis (X) of the device so as to be able to switchover under the effect of the magnetic field created by the moving permanent magnet 10.

The operation of this first configuration of the breaking device is as follows:

When an external mechanical action of determined minimum intensity is exerted on the actuation member OA, the latter is displaced in translation along the axis (X) of the device by driving the moving permanent magnet 10. In its rest position, the moving permanent magnet for example has no influence on the microswitch M'. The membrane 20' of the microswitch M' is then in a rest position, parallel to the substrate as represented in FIG. 9, or raised as represented in FIG. 10 by internal mechanical prestress. When the moving permanent magnet 10 is in its bottom working position, its magnetic field induces a magnetic component in the membrane 20' creating a magnetic torque forcing the microswitch M' to the closure position (FIG. 11).

The closure of the microswitch M' provokes an abrupt earthing making it possible to heat the resistive wire 9 and evaporate it so as to produce the energy needed to ignite the pyrotechnic charge 5.

The gases generated by the combustion of the pyrotechnic charge 5 then provoke the bursting of the body 1 along its fracture score 8 and simultaneously the ejection of the connecting piece 7, so as to break the main electric circuit between the two conductors 6*a*, 6*b*.

In the second configuration of the breaking device represented in FIG. 2, the moving permanent magnet 10 is replaced with an excitation coil 40 arranged in the axis (X) of the device. This breaking device is therefore no longer sensitive to an external mechanical action but to an electrical signal.

The microswitch M employed in this configuration is of the type of the first variant described hereinabove. It is therefore polarized by a fixed permanent magnet (not represented) for example joined to the substrate S and creating the magnetic field $B_0$ initially keeping the microswitch M in the opening position. The microswitch M is offset relative to the axis of the coil 40 so as to be under the influence of its substantially horizontal field lines. When the coil 40 is activated, the microswitch M is then placed under the predominant influence of the temporary magnetic field Bc (FIG. 7) parallel to its substrate S and controlling its membrane 20 between its two positions.

In FIG. 2, the excitation coil 40 is represented by a winding about a yoke frame, but it should be understood that it can take any other form. As represented in FIG. 5, it can notably be of planar type, integrated in the substrate S supporting the microswitch M.

The excitation coil 40 is mounted in parallel relative to the main electric circuit so as to be passed through by the current of the main electric circuit. Since the field generated by the coil 40 is proportional to the current that passes through it, the microswitch M can thus switchover when the current exceeds a determined threshold value dependent on the appliance to be protected. When this threshold value is exceeded, the temporary magnetic field Bc created by the excitation coil 40 generates a magnetic component in the membrane 20 of the microswitch M, of sufficient intensity to force it to its closure position (FIGS. 7 and 8), leading, as in the first configuration, to the ignition of the pyrotechnic charge 5 and the breaking of the main electric circuit by ejection of the connecting piece 7.

The making device represented in FIG. 3 also operates using an excitation coil 400 which is in this case mounted in parallel relative to the resistive wire 9 and to the microswitch M' employed. The microswitch M' employed in this making device is of the type of the first variant described hereinabove (FIGS. 4 to 8). Its membrane 20 is polarized by a fixed permanent magnet (not represented) and is controlled between its two positions by the temporary magnetic field Bc created by the coil 400. As previously, the coil 400 can be of planar type, integrated in the substrate S of the microswitch (FIG. 5). The excitation coil 400 is, for example, controlled on closure by a sensor C. This sensor C can, for example, take the form of a switch sensitive to one or more physical parameters, such as temperature, pressure, acceleration, etc. It is notably possible to consider an acceleration sensor comprising a number of MEMS-type microswitches in accordance with the invention placed on the electric circuit in series with the microswitch M controlling the ignition of the charge 5. A permanent magnet is, for example, set in motion according to the intensity of the acceleration or of the deceleration to actuate more or fewer microswitches. When an acceleration or deceleration threshold is reached, all the microswitches are closed allowing the current to pass to the excitation coil 400.

The connecting piece 700 is mounted joined to a piston P dividing the internal space of the body 1 into a first chamber 500 containing the pyrotechnic charge and a second chamber 600 that is passed through by the conductors 6*a*, 6*b* and containing the connecting piece 700. The piston P is, for example, retained by notches 300 formed on the internal face of the body 1.

In operation, when the coil 400 is activated, its magnetic field acts on the microswitch M forcing it into its closure position. The closure of the microswitch M causes the pyrotechnic charge 5 to heat up and therefore the gases to be generated. The gases created in the first chamber 500 thrust the piston P in translation accompanied by the connecting piece 700 until the latter links the two conductors 6*a*, 6*b*. The device can, for example, provide a relief valve mechanism 800 to dispel the combustion gases from the first chamber 500.

Obviously it is possible, without departing from the framework of the invention, to imagine other variants and refinements of detail and similarly consider the use of equivalent means.

The invention claimed is:

1. A device for breaking/making an electric circuit, the device comprising:

a pyrotechnic charge configured to be ignited, the combustion of the pyrotechnic charge brings about the breaking, respectively the making, of the electric circuit; and an ignition element for igniting the pyrotechnic charge, wherein:

the ignition element is connected to the electric circuit, the ignition element includes a microswitch with magnetic action that controls the ignition of the pyrotechnic charge, the microswitch is placed on a circuit branch linked to the electric circuit and to ground, the ignition element includes a heating resistive element mounted in series with the microswitch and is configured to ignite the pyrotechnic charge, and the microswitch is controlled by an excitation coil that is mounted in parallel relative to the microswitch, and the device includes two conductors and a connecting piece that joins the two conductors, the connecting piece is displaced under the effect of the gases generated by the combustion of the pyrotechnic charge, and the connecting piece is joined to a piston separating a first chamber including the pyrotechnic charge from a second chamber that is passed through by the two conductors.

2. The device as claimed in claim 1, wherein the excitation coil is mounted in parallel relative to the electric circuit.

3. The device as claimed in claim 1, wherein the connecting piece initially links the two conductors.

4. The device as claimed in claim 1, wherein the excitation coil is controlled by a sensor.

5. The device as claimed in claim 1, wherein the connecting piece is initially disconnected from the two conductors.

6. The device as claimed in claim 1, wherein the microswitch includes a membrane made of ferromagnetic material configured to be driven between two positions and be aligned on the field lines of a magnetic field.

7. The device as claimed in claim 1, further comprising a permanent magnet mounted on a moving actuation member on which an external mechanical action is exerted coaxially relative to the vertical axis of the device.

8. The device as claimed in claim 7, wherein the actuation member is displaced in translation upon application of a calibrated minimum external mechanical action from a bellows mechanism.

9. A device for breaking/making an electric circuit, the device comprising:

a pyrotechnic charge configured to be ignited, the combustion of the pyrotechnic charge brings about the breaking, respectively the making, of the electric circuit;

a permanent magnet mounted on a bellows mechanism; and an ignition element for igniting the pyrotechnic charge, wherein:

the ignition element is connected to the electric circuit, the ignition element includes a microswitch with magnetic action that controls the ignition of the pyrotechnic charge, and the device includes two conductors and a connecting piece that joins the two conductors, and the connecting piece is displaced under the effect of the gases generated by the combustion of the pyrotechnic charge.

10. The device as claimed in claim 1, wherein gases generated by the combustion of the pyrotechnic charge causes bursting of a body of the device along a fracture score and causes ejection of the connecting piece causing breaking of the electric circuit between the two conductors.

* * * * *